US007789585B2

(12) United States Patent
Christensen et al.

(10) Patent No.: US 7,789,585 B2
(45) Date of Patent: Sep. 7, 2010

(54) CONTROL BARRIER WITH ROTATABLE LEGS

(75) Inventors: Marc E. Christensen, Salt Lake City, UT (US); David J. Lipniarski, North Tonawanda, NY (US)

(73) Assignee: Off the Wall Products, LLC, Salt Lake City, UT (US)

( * ) Notice: Subject to any disclaimer, the term of this patent is extended or adjusted under 35 U.S.C. 154(b) by 0 days.

(21) Appl. No.: 12/475,990

(22) Filed: Jun. 1, 2009

(65) Prior Publication Data

US 2009/0278103 A1 Nov. 12, 2009

Related U.S. Application Data

(63) Continuation of application No. 12/117,644, filed on May 8, 2008, now Pat. No. 7,540,682.

(51) Int. Cl.
*E01F 9/012* (2006.01)

(52) U.S. Cl. ..... 404/6; 404/9; 116/63 P; 40/606.01

(58) Field of Classification Search ..... 404/6, 404/9; 116/63 P, 63 R; 256/24; 40/606.01, 40/606.15; 160/351
See application file for complete search history.

(56) References Cited

U.S. PATENT DOCUMENTS

| | | | |
|---|---|---|---|
| 2,451,875 | A | 10/1948 | Ryder |
| 3,135,235 | A | 6/1964 | Romano |
| 3,583,466 | A | 6/1971 | Dreyer |
| 3,593,681 | A | 7/1971 | Sernovitz |
| 5,031,683 | A | 7/1991 | Marvy et al. |
| 5,054,507 | A | 10/1991 | Sparks |
| 5,402,988 | A | 4/1995 | Eisele |
| 5,419,065 | A | 5/1995 | Lin |
| 5,863,030 | A | 1/1999 | Kotler et al. |
| 5,993,103 | A | 11/1999 | Christensen |
| 6,190,084 | B1 | 2/2001 | Ibañez |
| 6,199,833 | B1 | 3/2001 | Bilby et al. |
| 6,257,559 | B1 | 7/2001 | Mouri |

(Continued)

FOREIGN PATENT DOCUMENTS

| | | |
|---|---|---|
| JP | 11-323854 | 11/1999 |

OTHER PUBLICATIONS

Inline Plastic Barricades, www.movitbarricade.net, published at least as early as May 7, 2008.

(Continued)

*Primary Examiner*—Gary S Hartmann
(74) *Attorney, Agent, or Firm*—Workman Nydegger

(57) ABSTRACT

A control barrier includes a barrier wall having a front face and an opposing back face each extending between a top end and an opposing bottom end, a first recess being formed on the front face at the bottom end of the barrier wall. A first slot extends through the barrier wall from the first recess to the back face. A first foot coupled with the barrier wall and being movable between a first position wherein the first foot is at least partially disposed within the recess of the barrier wall and a second position wherein the first foot is rotated a least 45° relative to the first position and is removably positioned within the slot extending through the barrier wall.

20 Claims, 10 Drawing Sheets

U.S. PATENT DOCUMENTS

| | | | | |
|---|---|---|---|---|
| D457,649 | S | 5/2002 | Yang | |
| 6,676,113 | B2 | 1/2004 | Christensen | |
| 7,036,798 | B1 | 5/2006 | Olson | |
| 7,523,715 | B2 * | 4/2009 | Mettler et al. | 116/63 R |
| 7,540,682 | B1 * | 6/2009 | Christensen et al. | 404/6 |
| 2004/0206945 | A1 | 10/2004 | York, Jr. et al. | |
| 2006/0231820 | A1 | 10/2006 | Bilby | |

OTHER PUBLICATIONS

Traffic Management Products from Oaklands Plastic Ltd., www.oaklandsplastics.com/safety-barriers/traffic-management.asp?Mn=31, published at least as early as May 7, 2008.

Office Action issued on Oct. 10, 2008, in U.S. Appl. No. 12/117,644, filed May 8, 2008.

* cited by examiner

CONTROL BARRIER WITH ROTATABLE LEGS

CROSS-REFERENCE TO RELATED APPLICATIONS

This application is a continuation of U.S. patent application Ser. No. 12/117,644, filed on May 8, 2008, which for purposes of disclosure is incorporated herein by specific reference.

BACKGROUND OF THE INVENTION

1. The Field of the Invention

The present invention relates to barriers, and more particularly, portable, reusable, control barriers having rotatable feet.

2. The Relevant Technology

Control barriers are used in a variety of situations. For example, control barriers can be selectively positioned at special events, such as parades, to help direct crowds in a desired direction. Alternatively, control barriers can be put up to help limit access to select areas. In yet other embodiments, control barriers can be used to define an area such as an entertainment stage or the course for a sporting event.

Conventional control barriers have long comprised individual sawhorse type barriers and collapsible V-shape barricades. Such barriers, however, are generally lightweight and are easily tipped over. As a result, conventional control barriers have limited use in situations where crowds may be pushing against the barriers or where it is likely that the barriers may be impacted. In addition, such barriers are typically made of non-flexible metals or wood and have sharp corners. Accordingly, such structures pose a potential risk to crowds, athletes, or the like who may be pushed or otherwise come in contact with the barriers. Furthermore, such barriers are typically not connected and often have spaces or gaps extending therethrough. As such, it is possible for individuals to either slip between or through the barriers.

In one alternative embodiment, concrete barriers have been used. Although concrete barriers are not easily tipped over, such barriers are extremely heavy. As such, they are difficult to move and place in a desired location. Often, special equipment such as fork lifts or cranes are required. Furthermore, concrete barriers require a large storage area, are difficult and expensive to move over large distances, and are difficult to dispose of once they are damaged or begin to fail. Finally, concrete barriers can be dangerous in that they are rigid and non-forgiving when impacted by a person or object.

Other barriers comprise various gate or wall configurations. Such barriers, however, require extensive time to assemble and disassemble. Most gate or wall configurations have integral legs to provide stability. These configurations are typically cumbersome and bulky and not easily stackable. Conventional wall barriers must be stored in an upright position, thus requiring a large amount of space. It would be an improvement in the art to have crowd control barriers that are easily set up and taken down, are stable during use, can effectively restrict access, and/or take up a minimal amount of space during storage.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 1:
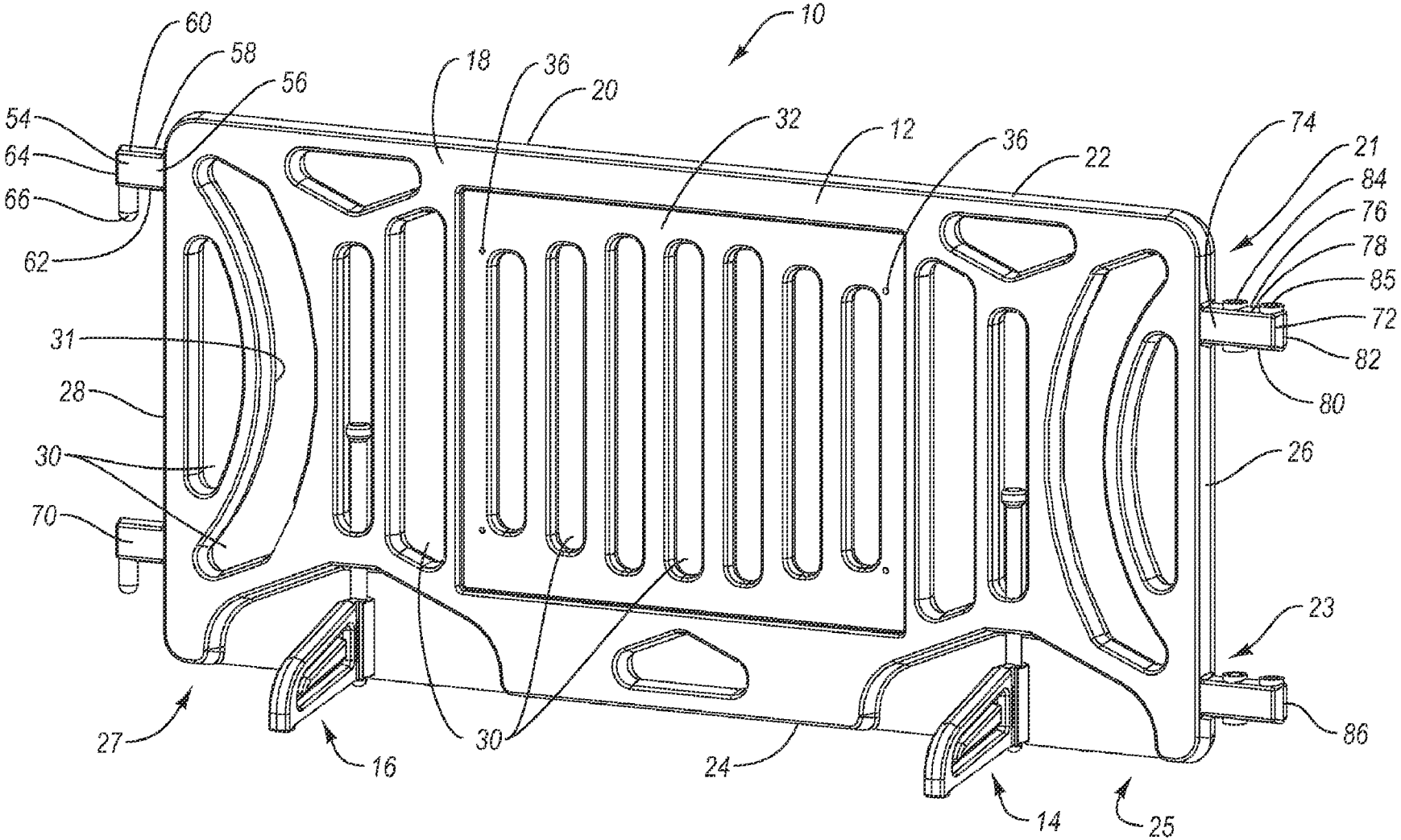
FIG. 1 is a front perspective view of one embodiment of a control barrier in a support position.
Figure 2:
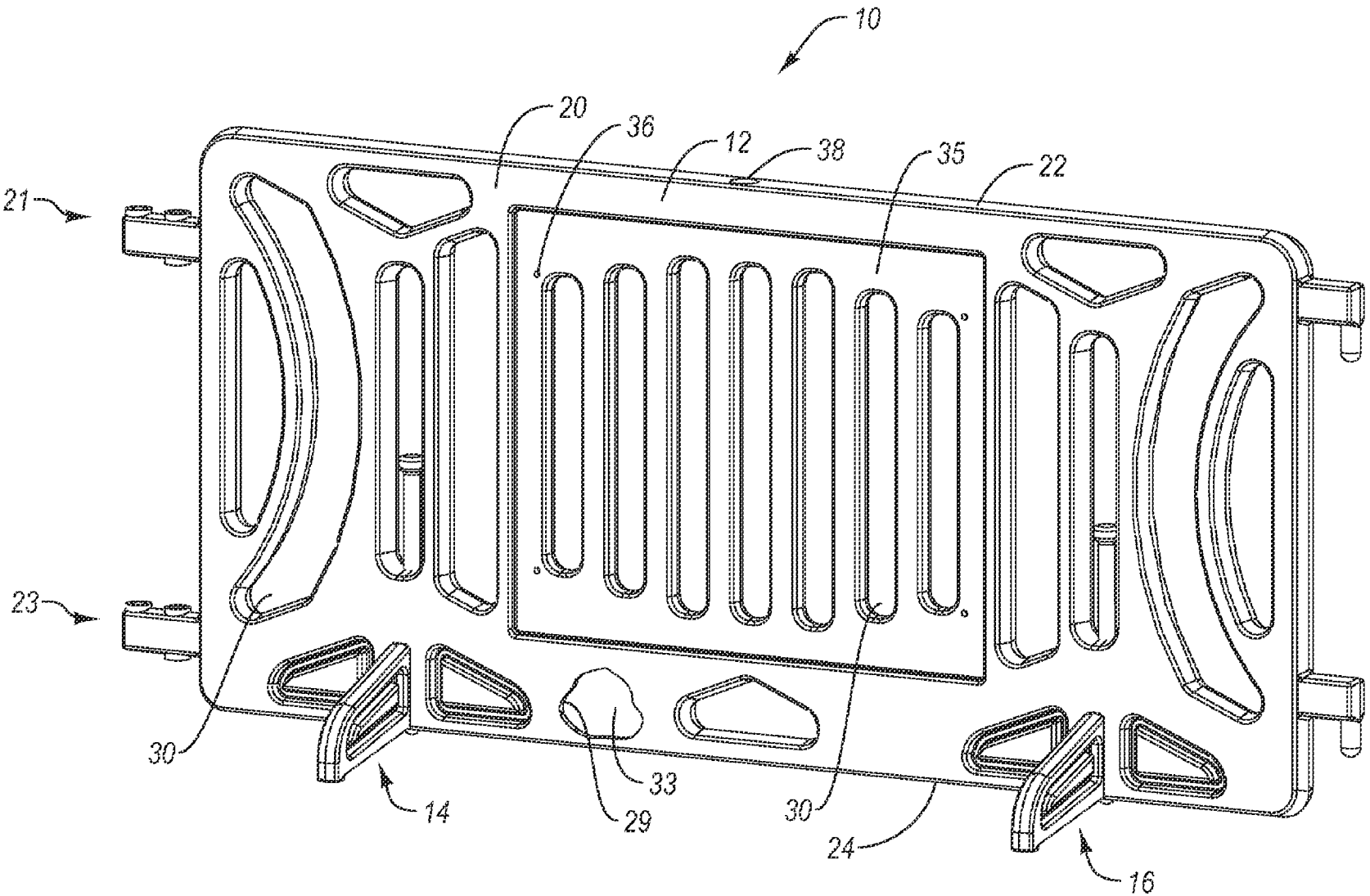
FIG. 2 is a back perspective view of the control barrier shown in FIG. 1 in the support position.
Figure 9:
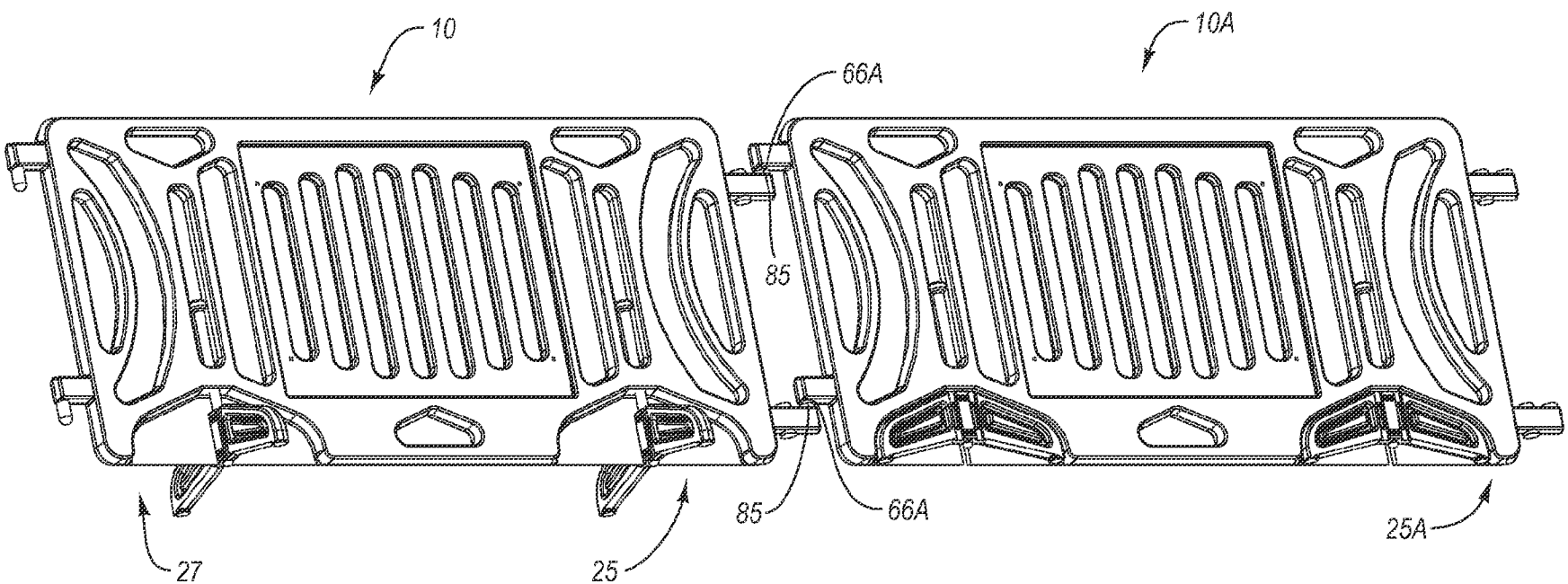
FIG. 9 is a perspective view of adjacent control barriers coupled together.

Depicted in FIGS. 1 and 2 is one embodiment of an inventive control barrier 10 incorporating features of the present invention. Control barrier 10 comprises a barrier wall 12 having a first support assembly 14 and a spaced second support assembly 16 attached thereto. One feature of the present invention is that support assemblies 14 and 16 can be selectively moved between a support position (FIG. 1) and a storage position (FIGS. 6 and 9) as will be described in further detail below. Barrier wall 12 has a thin, substantially parallel piped configuration that includes a front face 18 with an opposing back face 20. Faces 18 and 20 are substantially flat and have a substantially rectangular configuration. In other embodiments, faces 18 and 20 can be square or have other polygonal or irregular configurations. Furthermore, although not required, faces 18 and 20 are each typically disposed in a corresponding plane wherein the planes are parallel to each other.

Both of faces 18 and 20 extend between a top end 21 and an opposing bottom end 23. Top end 21 terminates at an elongated top surface 22 while bottom end 23 terminates at an elongated bottom surface 24. Both of top surface 22 and bottom surface 24 extend between a first end 25 and an opposing second end 27 of barrier wall 12. First end 25 terminates at a first side surface 26 while second end 27 terminates at a second side surface 28. Although front face 18, back face 20, top surface 22, bottom surface 24, and side surfaces 26, 28 are shown as being either vertically or horizontally disposed, one or more of these surfaces can be sloped relative to the others.

Barrier wall 12 typically has a maximum height extending between top surface 22 and bottom surface 24 in a range between about 30 inches to about 54 inches with about 36 inches to about 48 inches being more preferred; a maximum length extending between side surfaces 26 and 28 in a range between about 72 inches to about 120 inches with about 90 inches to about 102 inches being more preferred; and a maximum width extending between front face 18 and back face 20 in a range between about 1 inch to about 8 inches with about 2 inches to about 5 inches being more preferred. Other dimensions can also be used.

In one embodiment barrier wall 12 has an interior surface 29 bounding a chamber 33 as depicted in FIG. 2. If desired, means can be provided for at least partially filling chamber 33 with a ballast such as sand, water, or any other flowable material. Suitable means can include a fill hole 38 formed on top surface 22 and communicating with chamber 33. Fill hole 38 can also be positioned at any other location on top end 21 of barrier wall 12. A corresponding drain hole with cap or plug (not shown) can be formed on bottom surface 24 or bottom end 23 of barrier wall 12. Alternative fill and drain holes will be discussed later in the disclosure. In an alternative embodiment, barrier wall 12 can also be solid. The ability to add ballast to barrier wall 10 enables a user to selectively increase the weight of control barrier 10 so that it is not easily moved laterally or tipped when positioned. Removal of the ballast enables easy movement and stacking of control barriers 10.

In one embodiment of the present invention, means are provided for selectively securing an advertising display substantially flush against front face 18 or back face 20 of barrier wall 12. By way of example and not by limitation, depicted in FIG. 1 is a display recess 32 formed on front face 18. Display recess 32 is shown having a substantially rectangular configuration. In alternative embodiments, display recess 32 can have other geometrical configurations such as circular, triangular, square, or the like. A corresponding flat display, such as a sign, can be received into display recess 32. The display can be made of paper, plastic, cardboard, or the like that is sized so as to fit within display recess 32. In one embodiment, display recess 32 is sufficiently deep such that when the display is received therein, the front face of the display is substantially flush with the surface of front face 18. This helps to prevent people standing adjacent to control barrier 10 from catching an edge of the display.

Secured within each corner of display recess 32 is an insert 36 having a threaded hole. The display is secured to barrier wall 12 by passing bolts through apertures in the display and then threading the bolts into the holes of corresponding inserts 36. One example of a display with corresponding bolts is shown in U.S. Pat. No. 6,676,113, issued Jan. 13, 2004 ("the '113 patent") which is incorporated herein by specific reference. As depicted in FIG. 2, a similar display recess 35 and corresponding structure for attaching a display therein can also be formed on back face 20 of barrier 12. Different structures can be used to perform the same function as inserts 36 and corresponding bolts. For example, pin assemblies, rivets, clips, adhesive, and the like can be used. Furthermore, barrier wall 12 can also provide retention lips and a transparent cover to assist in securing display 34 within display recess 32. Such embodiments are described in U.S. Pat. No. 5,993,103 which is incorporated herein by specific reference.

There are several benefits to using the above structure for attaching advertising display 34 to barrier wall 12. Most notably, by attaching the display flush against the surface of barrier wall 12, projecting corners and edges are eliminated. As such control barriers 10 can be used in sporting events and for directing crowds while minimizing the potential injury to an individual who may impact the control barriers. Furthermore, the above structure provides easy attachment and removal of the display and provides for prominent disclosure of the advertising display.

As also depicted in FIGS. 1 and 2, a plurality of wind ports 30 extend through barrier wall 12 between front face 18 and back face 20. Each wind port 30 is bounded by an encircling interior wall 31. Wind ports 30 can be positioned and configured as desired. There are some benefits in forming some of wind ports 30 adjacent to the perimeter edge of barrier wall 12 so that wind ports 30 can be used as handles for carrying control barrier 10. Wind ports 30 allow air to freely pass through barrier wall 12 so that control barrier 10 does not tip over from wind pressure. Barrier wall 12 may have more or fewer wind ports 30 depending on the particular application. In some embodiments, wind ports 30 can be eliminated or substantially reduced. Furthermore, wind ports 30 can be formed in any number of different sizes and shapes.

The present invention also includes means for mechanically mating a pair of barriers together such that a number of discrete control barriers can be stacked in a substantially flat interlocking configuration. By way of example and not by limitation, a plurality of tenons can project from front face 18 and a plurality of mortises can be recessed on front face 18. Similarly, a plurality of tenons can project from back face 20 and a plurality of mortises can be recessed on back face 20. By way of illustration, see tenons and mortises 42, 48, 50, 52 depicted in the '113 patent.

The tenons on front face 18 of control barrier 10 are configured to complementary mate within the mortises on back face 20 of a control barrier 10A (control barrier 10A having the same configuration as control barrier 10) when control barrier 10A is stacked on top of control barrier 10. In this configuration, the tenons on back face 20 of control barrier 10A also mate within the mortises on front face 18 of control barrier 10. As a result of the mating between the mortises and the tenons, a plurality of control barriers can be easily stacked in a close, compact and substantially flat configuration wherein the barriers are interlocked so as to prevent one or more barriers from accidentally sliding off of another barrier. As such, control barriers 10 are mated together and the resulting mated control barriers have a substantially box shaped configuration. This is particularly helpful as the height of the stacked barriers increases. Advantageously, the mated control barriers 10 are easily stacked for transport and/or storage.

Although not required, the tenons preferably have a configuration complementary to the mortises so that they couple in relatively close tolerance. In one embodiment, barrier wall 12 has two tenons and two mortises on each of front face 18 and back face 20. In alternative embodiments, front face 18 and 20 can each comprise more or fewer tenons and mortises. Furthermore, front face 18 may comprise only tenons while back face 20 may comprise only mortises. The tenons and mortises can have a variety of alternative configurations and need only be constructed so that they mate together. In this manner, control barrier 10 is provided with a clean, simplistic appearance and yet obtains the benefit of a stacking feature.

The present invention also includes means for interconnecting adjacent control barriers 10. By way of example and not by limitation, FIG. 1 shows a first retention arm 54 projecting from second sidewall 28 of barrier wall 12. First retention arm 54 has a front face 56 and a back face 58 that are typically flush with front face 18 and back face 20, respectively, of barrier wall 12. First retention arm 54 also has a top surface 60, bottom surface 62 and one exposed sidewall 64. Extending from the bottom surface 62 is a pin 66. Pin 66 is typically spaced apart from second sidewall 28 so as to allow room for maneuvering control barrier 10 when it is connected to another control barrier 10.

First retention arm 54 can also be configured to have a port (not shown) partially or completely extending through first retention arm 54 from top surface 60 to bottom surface 62. As discussed below in greater detail, the port is configured to receive pin 66 of another barrier. Preferably, the port is spaced apart from pin 66 so that they are not in vertical alignment. The port can be positioned either before or after pin. One example of such as port is port 68 disclosed in the '113 patent which was previously incorporated by reference.

A second retention arm 70 extends from second sidewall 28 of barrier wall 12 at a position below first retention arm 54. Second retention arm 70 has substantially the same configuration and performs substantially the same function as first retention arm 54. Thus, for ease of reference, like structural elements between first retention arm 54 and second retention arm 70 are identified herein by like reference characters.

A first receiving arm 72 extends from first sidewall 26 of barrier wall 12. First receiving arm 72 has a front face 74 and back face 76 that are typically flush with front face 18 and back face 20, respectively, of barrier wall 12. First receiving arm 72 also has a top surface 78, bottom surface 80, and an exposed sidewall 82. First receiving arm 72 is shown having an inside port 84 and an outside port 85 each extending partially or completely through first receiving arm 72 by extending through top surface 78 and either toward or through bottom surface 80. Ports 84 and 85 are configured to receive a pin 66 of another control barrier 10.

A second receiving arm 86 is shown extending from the first sidewall 26 of barrier wall 12 at a position below first receiving arm 72. Second receiving arm 86 has substantially the same configuration and performs substantially the same function as first receiving arm 72. Thus, for ease of reference, like structural elements between first receiving arm 72 and second receiving arm 86 are identified herein by like reference characters. While first receiving arm 72 shows two ports 84 and 85, it will be recognized that first receiving arm 72 and second receiving arm 86 are not limited to this particular configuration. In one embodiment, the receiving arms may have one or three or more ports. In another embodiment, the receiving arms may have one port and one pin similar to first retention arm 54.

The foregoing configuration of pins and ports advantageously allows a user to couple one control barrier 10 with adjacent control barriers having substantially the same configuration. For example, depicted in FIG. 9, identical control barriers 10 and 10A are coupled together end to end by having pins 66A of control barrier 10A being received in outside ports 85 of control barrier 10 to effectively connect control barriers 10 and 10A together. This pin coupling acts as a hinge to allow control barriers 10 and 10A to be angled in any desired orientation relative to each other.

A third control barrier can then be connected to first end 25A of control barrier 10A, first end 25 of control barrier 10A, or second end 27 of control barrier 10 using a similar coupling. For example, in FIG. 4 of the '113 patent, three control barriers are shown connected together in a T-shape configuration. The connected control barriers can also moved to form a Y-shape or a variety of other interconnected configurations which separate discrete areas. Those skilled in the art will recognize that control barrier 10 is not limited to a certain number of retention arms or receiving arms, but that more or fewer retention arms or receiving arms may be implemented.

In the depicted embodiment first receiving arm 72 and second receiving arm 86 are hollow and each bound a cavity that communicates with chamber 33 of barrier wall 12. Inside port 84 and outside port 85 extend through top surface 78 and bottom surface 80 of receiving arms 72 and 86 so as to communicate with the cavity and chamber. As a result, inside port 84 and outside port 85 can comprise a drain hole for removing ballast from chamber 33. That is, the ballast can be drained from chamber 33 by tipping barrier wall 12 so that the ballast drains out of inside port 84 and/or outside port 85. Ports 84 and 85 can also be used as fill hole for inserting ballast into chamber 33. In this embodiment, only bottom end 23 of barrier wall 12 can be filed with ballast. In other embodiments receiving arms 72 and 86 can be made solid so that inside port 84 and outside port 85 do not communicate with chamber 33. As a result, chamber 33 can be filled to a larger extend with ballast by use of inlet port 38 on top surface 22.

In another alternative embodiment it is also appreciated that pins 66 can upwardly project from top surface 60 of retention arms 54 and 70. In this embodiment, the pins 66 upwardly extend into ports 84 and 85 from the bottom surface of receiving arms 72 and 86.

Figure 3:
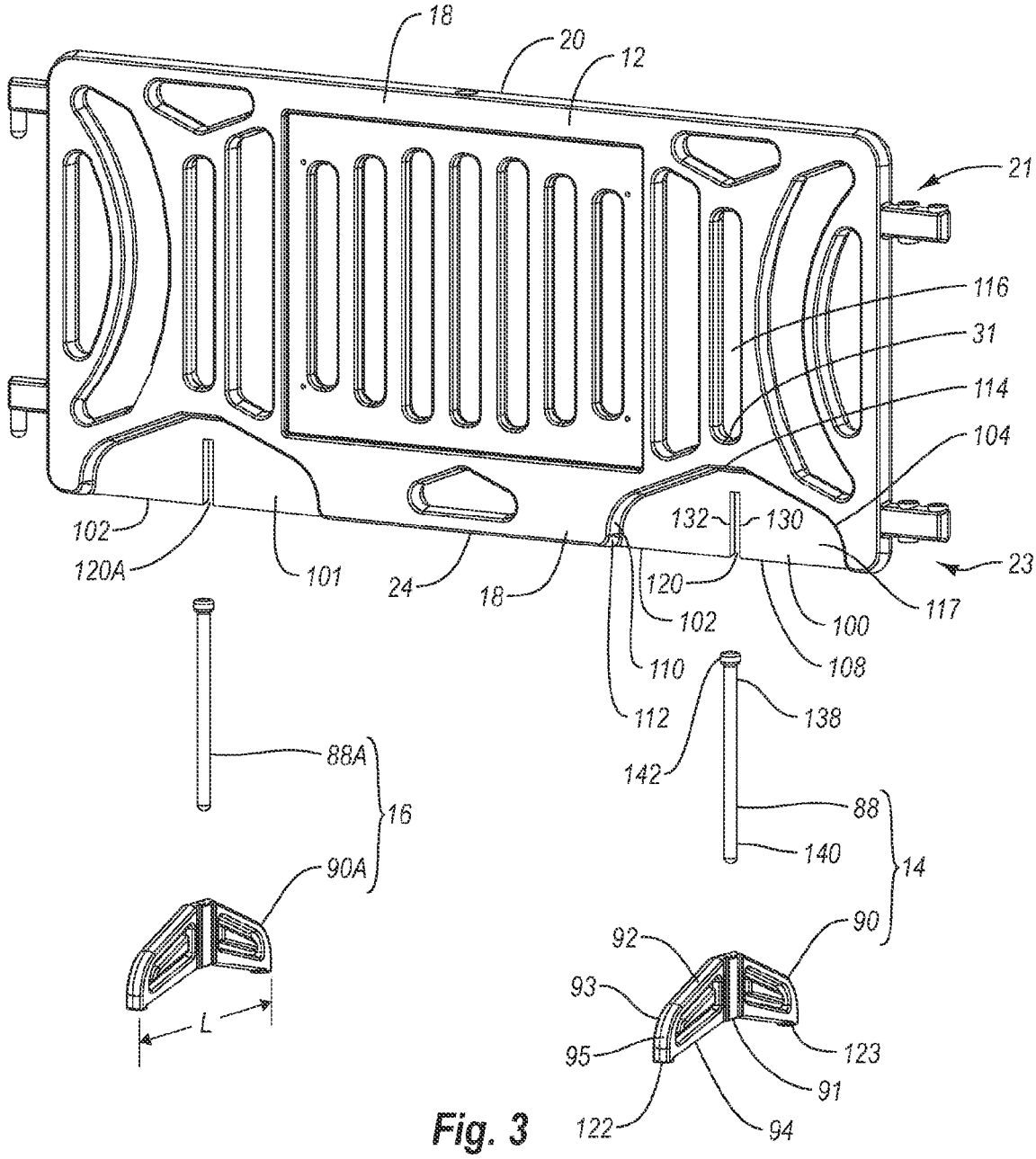
FIG. 3 is an exploded view of the control barrier shown in FIG. 1.

Turing to FIG. 3, barrier wall 12 also has a pair of spaced apart recesses 100 and 101 that are recessed on front face 18 at bottom end 23 so as to intersect with bottom surface 24. Recesses 100 and 101 are substantially identical and generally have an elongated, semi-circular configuration with a flat base 102 that extends along bottom surface 24. Each recess has an arched perimeter 104 that upwardly extends from the opposing ends of flat base 102 towards top end 21.

Each recess 100 and 101 is bounded by an inside face 106 and an arched shoulder 112. Inside face 106 has the same elongated, substantially semi-circular configuration as recess 100 with a flat base 108 that extends along a portion of bottom surface 24 and an arched perimeter edge 110 that upwardly extends from the opposing ends of flat base 108 towards top end 21. Arched shoulder 112 outwardly projects from perimeter edge 110 of inside face 106 to front face 18. Inside face 106 and shoulder 112 each have a central apex 114. The portion of barrier wall 12 extending from inside face 106 to back face 20 comprises a coupling wall 117.

As will be discussed below in greater detail, an opening 116 extends between front face 18 and back face 20 of barrier wall at a location upwardly spaced apart from apex 114. Opening 116 can comprise one of wind ports 30. As perhaps best depicted in FIG. 5, a passage 118 extends from shoulder 112 at apex 114 to interior wall 31 bounding opening 116. A slot 120 passes from inside face 106 to back face 20 and linearly extends from base 108 to a location spaced below apex 114. Slot 120 is typically vertically aligned with passage 118 and is bounded by opposing inside edges 130 and 132 of coupling wall 117 (FIG. 3).

In alternative embodiments, slot 120 can extend to apex 114. Furthermore, shoulder 112 need not form an arch and both slot 120 and passage 118 need not be positioned on an apex of shoulder 112. Recess 101 has the same configuration and related structures as recess 100 and thus like elements are referred to by like reference characters.

Turning now to another aspect of the present invention, FIG. 1 shows two support assemblies 14 and 16 attached to barrier wall 12. By way of example and not by limitation, FIG. 3 shows support assembly 14 comprising a leg 88 and a foot 90. Foot 90 has substantially the same configuration as recess 100 so that foot 90 can fit within recess 100. More specifically, foot 90 is shown having a substantially arcuate configuration with a front face 91, a back face 93, and a sidewall 95 extending therebetween. Sidewall 95 includes an arched top portion 92 complementary to shoulder 112 and a generally arched bottom portion 94. Bottom portion 94 is arched so that bottom portion 94 forms two spaced apart supports 122 and 123 that rest on the ground surface during use. If desired, a rubberized pad can be mounted on each support 122 and 123 to minimize sliding of control barrier 10.

It is appreciated that top portion 92 and/or bottom portion 94 can have a variety of different configurations such as being substantially flat, V-shaped, semi-circular or other configurations. For example, see FIG. 4 in the '113 patent.

Figure 6:
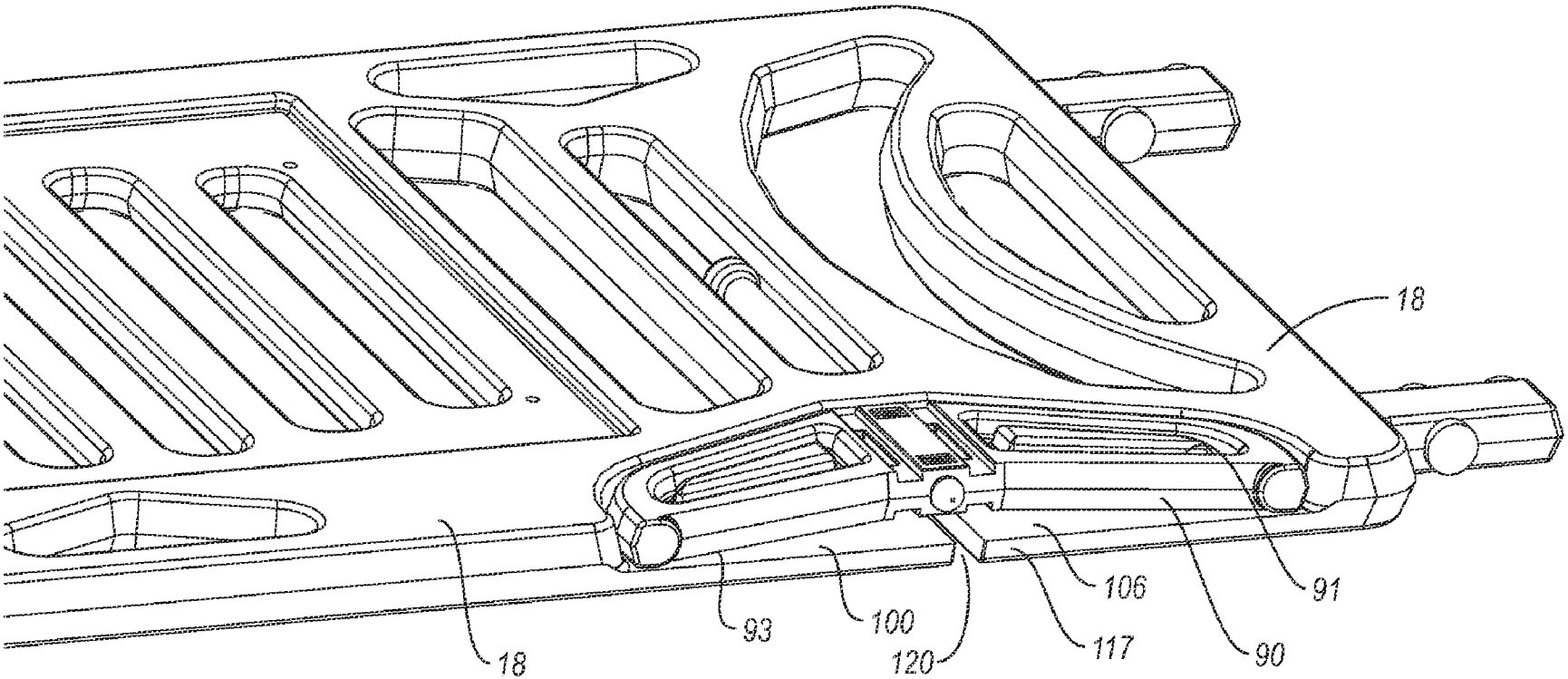
FIG. 6 is an enlarged perspective view of the support assembly shown in FIG. 5 with the foot being advanced into a storage position.

Foot 90 has a length L that is long enough so that support assembly 14 can maintain barrier wall 12 in a stable standing position. Length L is typically within a range between about 12 inches to about 48 inches with about 20 inches to about 30 inches being more common. Other dimensions can also be used. Foot 90 has a width extending between front wall 91 and back wall 93 that is substantially the same as the width of shoulder 112 and thus is typically less than the thickness of barrier wall 12. Accordingly, when back wall 93 of foot 90 is disposed adjacent to inside face 106, as shown in FIG. 6, front wall 91 of foot 90 is generally flush with front face 18 of barrier wall 12.

Figure 4:
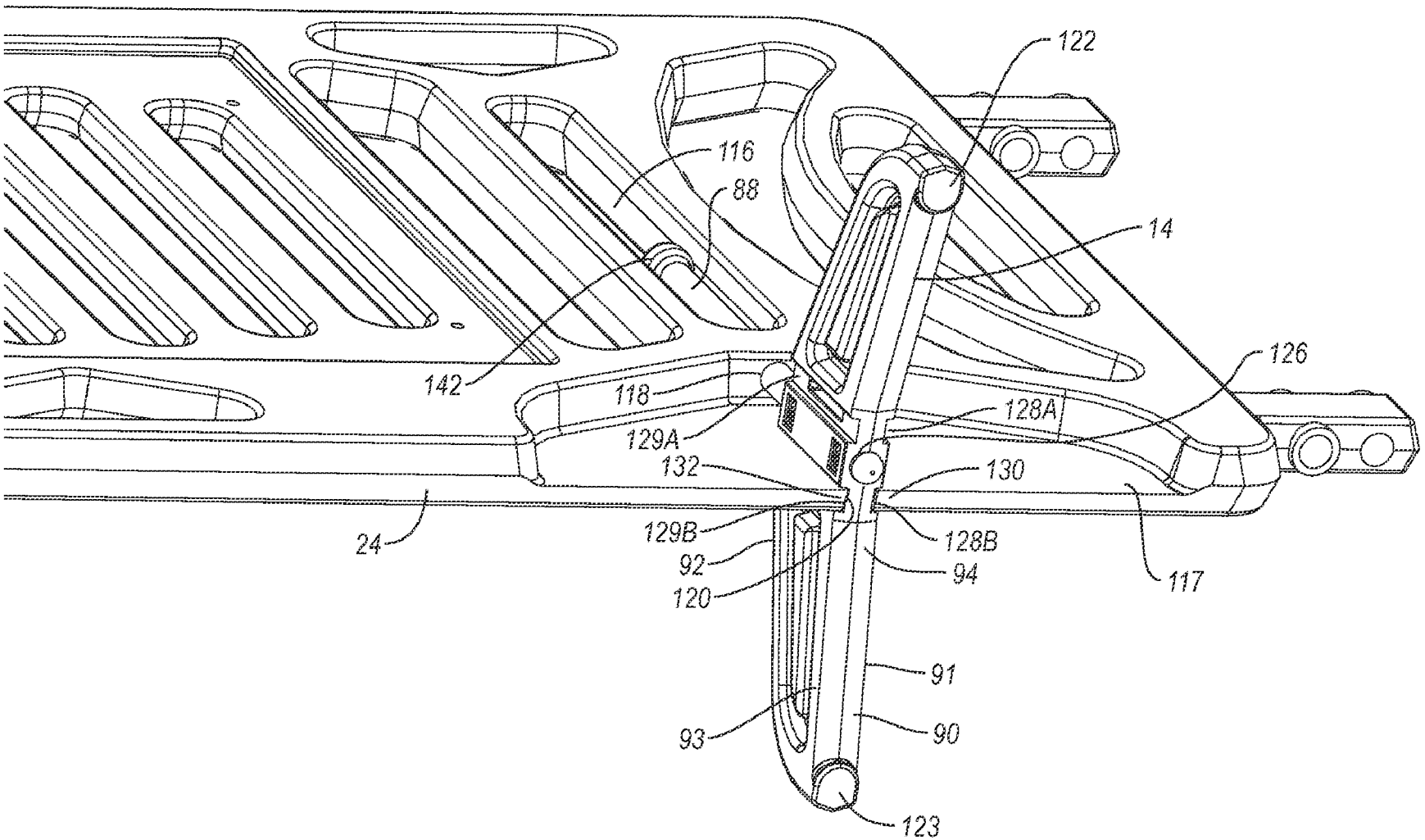
FIG. 4 is an enlarged perspective view of the support assembly of the control barrier shown in FIG. 1 in a support position.

Turning to FIG. 4, foot 90 has a passage 126 that centrally extends through foot 90 from top portion 92 to bottom portion 94. A pair of channels 128A and B are recessed on front wall 91 and extend from top portion 92 to bottom portion 94. Channels 128A and B are spaced apart on opposing sides of passage 126 and are each configured to receive inside edge 130 or 132 of coupling wall 117.

Similarly, channels 129A and B are recessed on back wall 93 of foot 90 and extend from top portion 92 to bottom portion 94. Channels 129A and B are positioned on opposing sides of passage 126 in substantial alignment with channels 128A and B and are likewise configured to receive inside edge 130 or 132 of coupling wall 117.

Returning to FIG. 3, leg 88 has a first end 138 and an opposing second end 140. In the depicted embodiment, leg 88 has a substantially cylindrical configuration is adapted to be receive within passage 118 (FIG. 5) of barrier wall 12 so that leg 88 is free to rotate within passage 118 and slide vertically up and down within passage 118 along the length of leg 88. By increasing the size of opening 118, leg 88 can have a variety of different transverse cross sectional configurations and still be permitted to rotate and slide within passage 118. An enlarged head 142 is secured on first end 138 of leg 88 and has a diameter larger than the diameter of passage 118. As a result, head 142 functions as a stop to prevent first end 138 of leg 88 from traveling through passage 118. Second end 144 is positioned within passage 126 (FIG. 4) of foot 90 and is secure to foot 90 by bolts, fasteners, adhesive, press-fit connection, or any other conventional methods.

Support assembly 14 can be selectively moved between a support position and a storage position. FIG. 4 depicts support assembly 14 in the support position. In this position, leg 90 is rotated substantially 90° relative to barrier wall 12 and is slid within slot 120 so that opposing edges 130 and 132 of coupling wall 117 are received within channels 128B and 129B of foot 90. As a result of snug coupling of coupling wall 117 within channels 128B and 129B, foot 90 is securely locked in this support position. As a result of slot 120 not extending all the way to apex 114, supports 122 and 123 project below bottom surface 24 of barrier wall 12 for resting on a ground surface. In this support position, leg 88 extends from foot 90 through passage 118 and into opening 116 with head 142 being positioned within opening 116.

Figure 5:
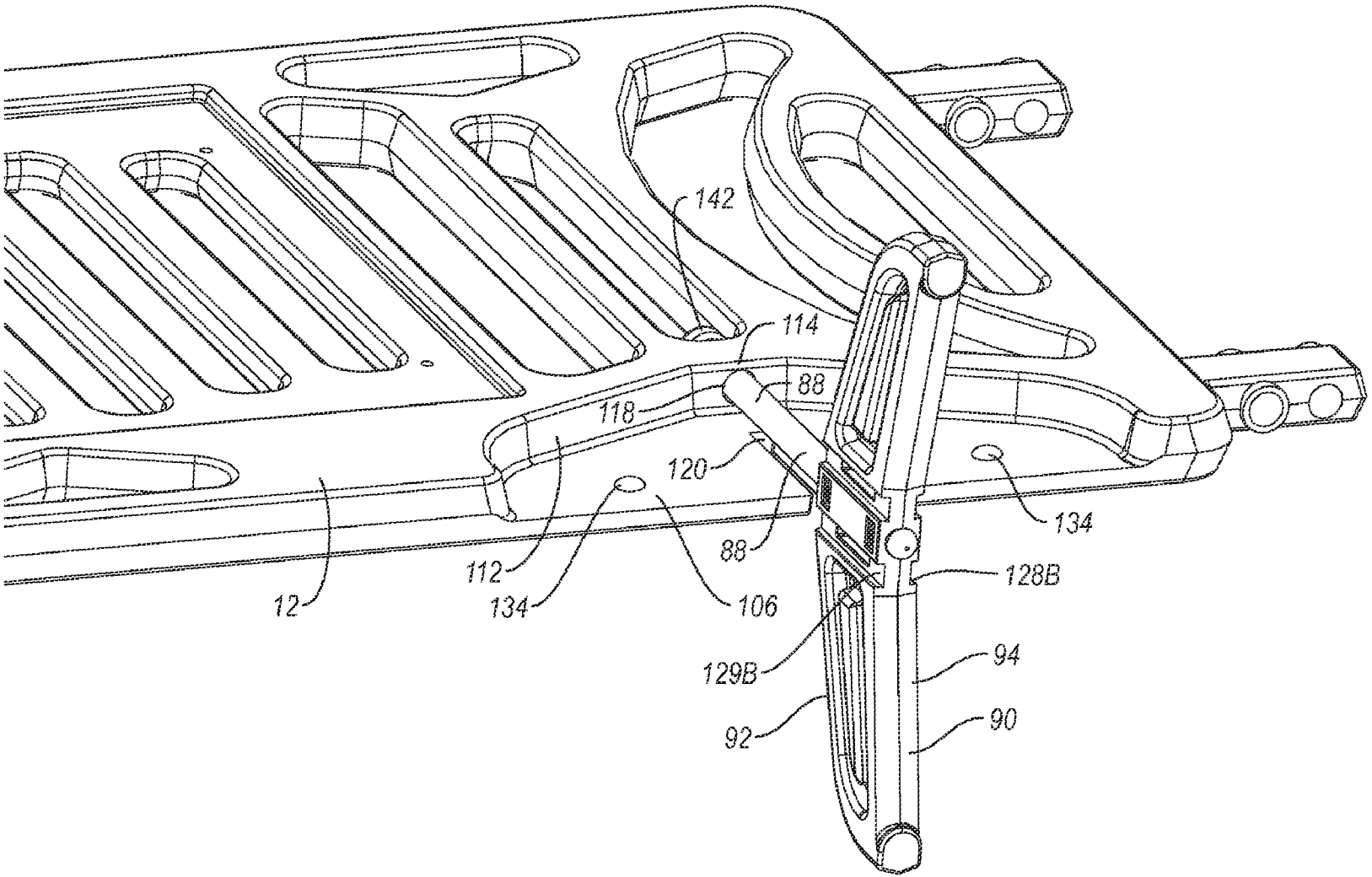
FIG. 5 is an enlarged perspective view of the support assembly shown in FIG. 4 with the foot being retracted from the slot of the barrier wall.

To move first support assembly 14 into the storage position, leg 90 is pulled out of slot 120 as depicted in FIG. 5. Leg 88 and head 142 retain foot 90 coupled with barrier wall 12. Once foot 90 is free of slot 120, foot 90 is then rotated 90° so as to be substantially parallel with barrier wall 12. Foot 90 is then pushed into recess 100 as depicted in FIG. 6 so as to be in the storage position. As a result of foot 90 being positioned within recess 100 as opposed to simply on top of front face 18, multiple control barriers 10 can now be easily stacked one on top of the other in a flat orientation. Furthermore, as a result of coupling wall 117, foot 90 is precluded from unwanted rotation during movement or shipment of control barrier 10.

Second support assembly 16 comprises a leg 88A and a foot 90A having the same configuration and assembly as leg 88 and foot 90. Second support assembly 16 is coupled to barrier wall 12 is the same manner as first support assembly 14 and is moved between the support position and the storage position in the same manner as first support assembly 14.

In one embodiment of the present invention, means are provided for securing foot 90 within recess 100 so that it does not accidentally fall out of recess 100. In one embodiment of such means, foot 90 can be slightly arched along the length thereof so that the opposing ends of foot 90 flexibly bias against coupling wall 117 as foot 90 is received within recess 100. In alternative embodiments one or more projections 134 can be formed on inside face 106 of coupling wall 117 (FIG. 5) so as to bias against front wall 91 or back wall 93 of foot 90 so as to secure foot 90 within recess 100. Alternatively, projections 134 can be formed on front wall 91 and/or back wall 93 of foot 90 for biasing against coupling wall 117. A pin, clamp, or other fastener can also be secured leg 88 within opening 116 so as to prevent foot from pulling out of recess 100.

To move first support assembly 14 back to the support position, foot 90 is simply pulled out of recess 100, again rotated approximately 90° and then slide back into slot 120. As a result of having two pairs of channels 128 and 129, it is appreciated that foot 90 can be rotated in either direction for inserting within slot 120. In contrast to rotating foot 90° for coupling with slot 120, it is appreciated that slot 120 and channels 128 and 129 can be oriented so that foot 90 can be rotated over an angle of at least 45° or in a range between about 75° to about 105° and then coupled within slot 120. Other angles can also be used.

In one embodiment it is also appreciated that opposing channels 128A, 129A and 128B, 129B can be oriented so that the thickness of foot 90 therebetween tapers. For example, the thickness of foot 90 between channels 128B and 129B can be thinner at top portion 92 and become thicker at bottom portion 94. As a result, this enables foot 90 to be locked within slot 120 at different positions along the length of slot 120. For example, if the ground is sloped or uneven and the operator wants control barrier 10 level, foot 90 can be positioned within slot 120 at a different position than foot 90A is positioned within slot 120A.

In one alternative embodiment, channels 128 and 129 on foot 90 can be replaced with outwardly projecting ribs. In turn, corresponding channels can be formed on the end faces of inside edges 130 and 132 of coupling wall 117 so the ribs can be interlocked within the channels. In yet other alternative embodiments, channels 128 and 129 can be eliminated and foot 90 can simply be wedged or inserted into slot 120. In still other alternative embodiments coupling wall 117 need not bound all of one side of recess 100. For example, openings can be formed through coupling wall 117 or coupling wall 117 can comprise two or more differently configured members, such as a pair of forks, that project from barrier wall 12 on opposing sides of leg 88 so as to form inside edges 130 and 132.

Figure 7A:
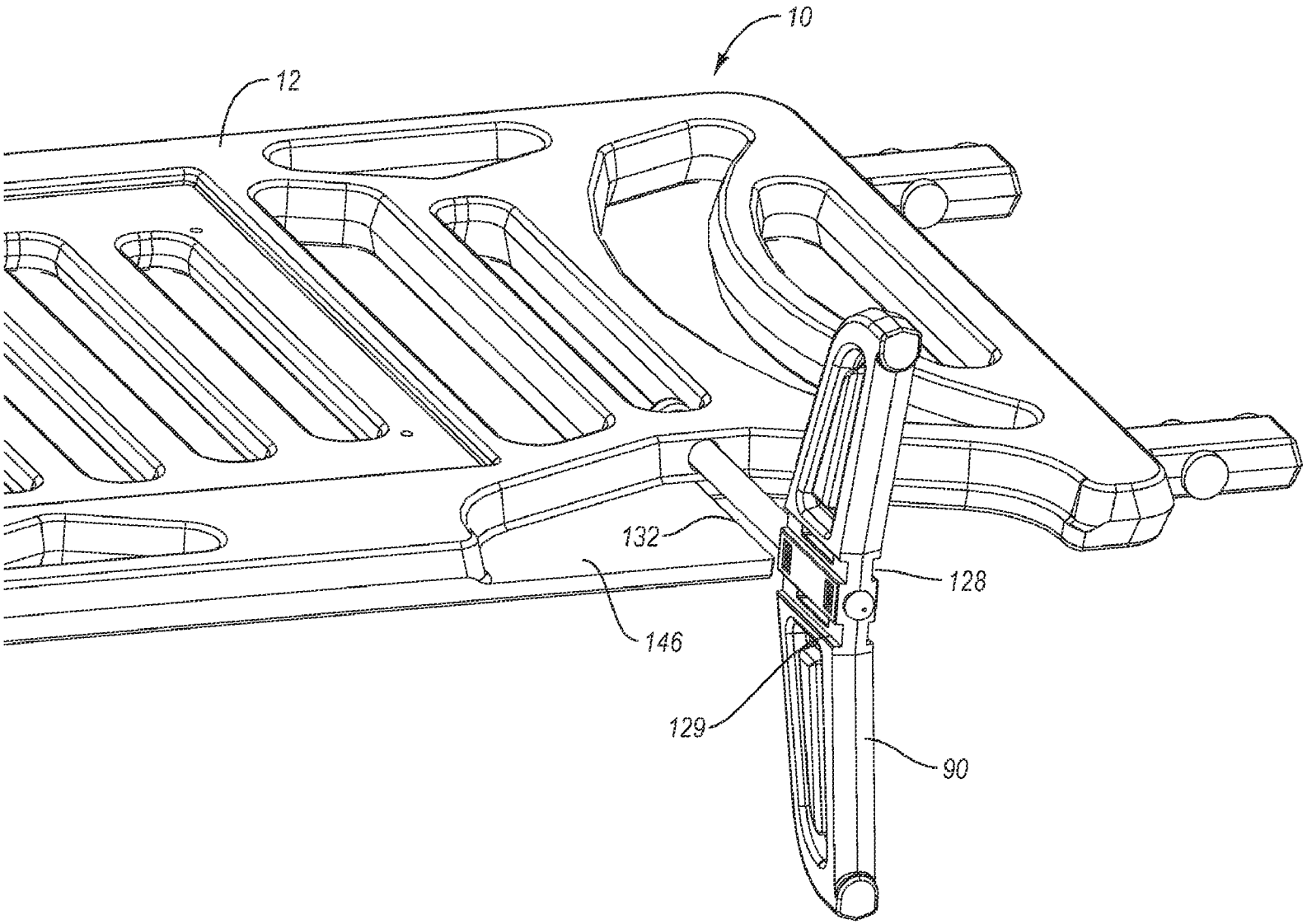
FIG. 7A is a perspective view of an alternative embodiment of a control barrier that includes only a portion of the coupling wall shown in FIG. 3.

Depicted in FIG. 7A is an alternative embodiment of a control barrier 10A wherein like elements between control barrier 10 and 10A are identified by like reference characters. Control barrier 10A is substantially the same as control barrier 10 except that control barrier 10A comprises a coupling wall 146 that comprises only half of coupling wall 117. In this embodiment, foot 90 can still be rotated between the support position and the storage position and inside edge 132 of coupling wall 146 is still received within a channel 128 or 129 for locking foot 90 in the support position.

Figure 7B:
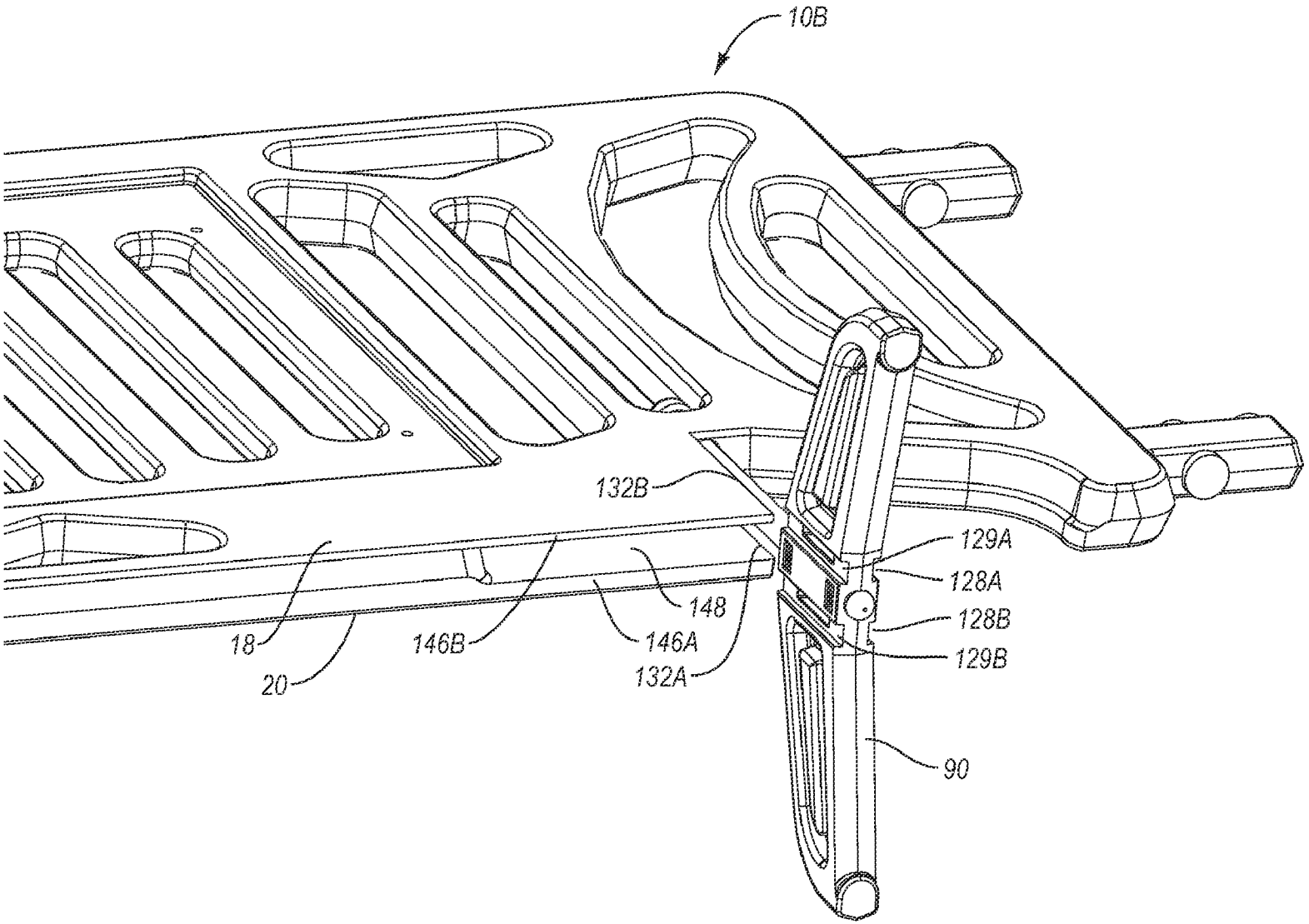
FIG. 7B is a perspective view of an alternative embodiment of a control barrier that includes a cavity for receiving a portion of the foot when the foot is in the storage position.

In an alternatively embodiment depicted in FIG. 7B, a control barrier 10B is depicted which includes a first coupling wall 146A that is substantially flush with back wall 20 and that extends to inside edge 132 and a second coupling wall 146B that is substantially flushed with front face 118 and likewise extends to an inside edge 132B. Insides edges are configured to be received within channels 129A and B or channels 128A and B. A cavity 148 is formed between coupling walls 146A and B. Foot 90 is sized so that in the storage position, half of foot 90 is received within cavity 148 so as to prevent unwanted rotation of foot 90.

Figure 8:
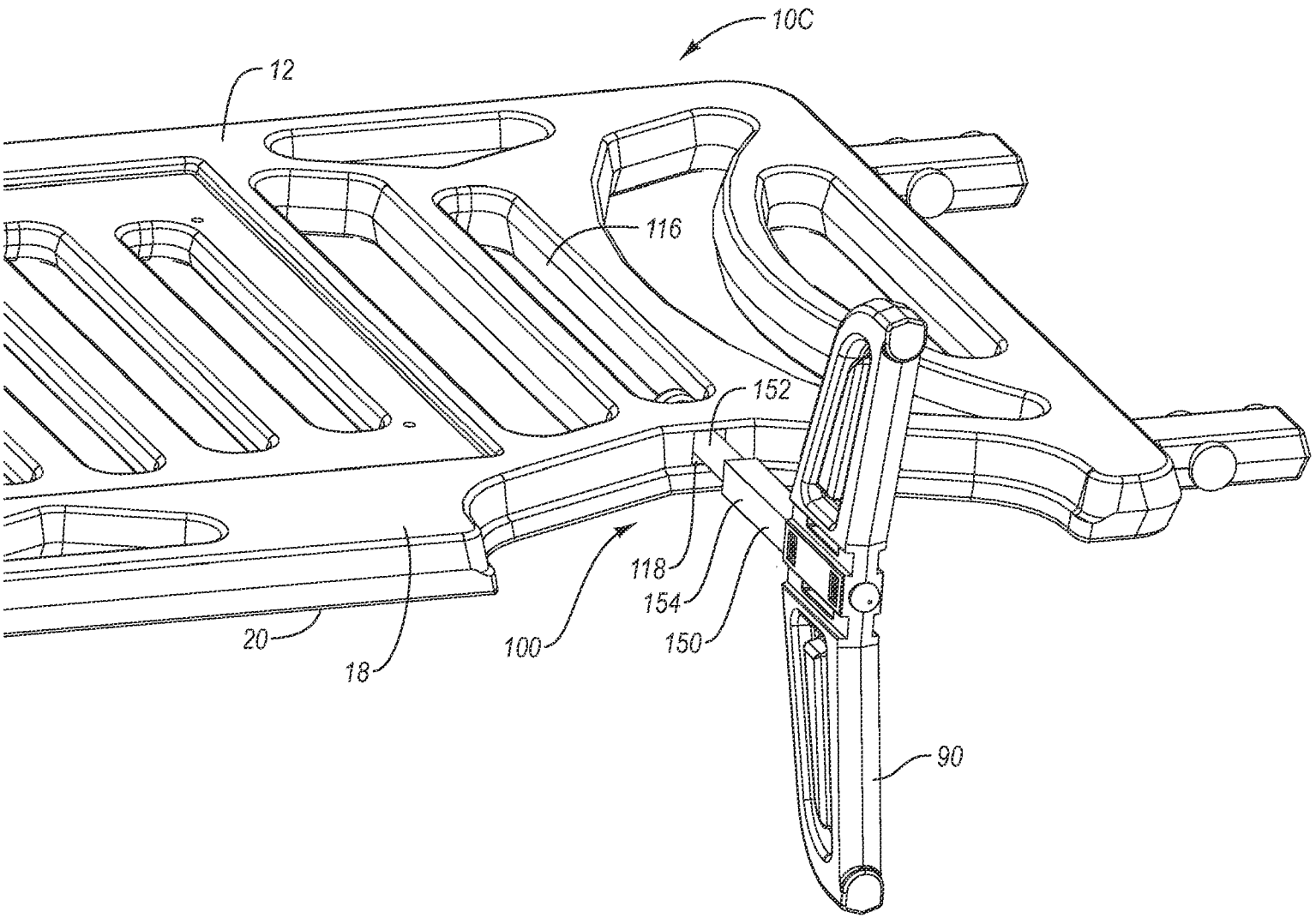
FIG. 8 is a perspective view of an alternative embodiment of a control barrier wherein a portion of the leg for the support assembly and the passages in which the leg is received have a complementary interlocking configuration.

Depicted in FIG. 8 is an alternative embodiment of a control barrier 10C incorporating features of the present invention. In this embodiment, in contrast to having a coupling wall, recess 100 extends all the way through barrier wall 12 between front face 18 and opposing back face 20. However, passage 118 that extends from recess 100 to opening 116 has a substantially square transverse cross section. A leg 150 extends from foot 90 and has a first end portion 152 having a substantially cylindrical configuration. Leg 150 also has an opposing second end portion 154 that has a substantially square transverse cross section that is complementary to passage way 118. Foot 90 can again move between the support position and the storage position. In the support position, foot 90 is rotated substantially orthogonal to barrier 12 as depicted in FIG. 8 while first end portion 152 of leg 150 is received within passage 118. Leg 150 is then advanced into passage 118 so that second end portion 154 is inserted within passage 118. The complimentary configuration of second end portion 154 and passage 118 lock leg 150 and foot 90 relative to barrier wall 112.

To move leg 90 to the storage position, foot 90 is then again pulled out away from recess 100 so that first portion 152 of leg 150 is again within passage 118. Foot 90 is then rotate 90° so as to be substantially parallel with barrier wall 12. Foot 90 is then again advanced back into recess 100 so that second end portion 154 of leg 150 is received and lock within passage 118. It is appreciated that there are a variety of alternative interlocking configurations for forming passage 118 and second end portion 154 such as any polygon, ellipse, or irregular configuration.

In one embodiment, barrier wall 12 and each foot 90 is discretely made from plastic by a rotational molding process. Alternatively, other molding processes, such as injection molding, can also be used to manufacture the parts. The plastic used is preferably a resiliently deformable plastic material having strong, semi-rigid and energy absorbing properties. Such materials include linear or cross link plastics. Examples of conventional plastics include polyethylene, polyvinylchloride, nylon, polycarbonate, and polypropylene. Additives such as dyes, pigments, and reinforcements, such as fibers, can also be added to the material. Florescent dies can also be added to help control barriers 10 glow at night for better direction of traffic. The material can also be selected to enable old or broken barriers to be ground down and recycled into new barriers. It is also appreciated that barrier wall 12 can be made from wood, metal, composites, or any other desired material. Legs 88 and 88A are typically made of metal, such as aluminum, but can also be made of plastic and other materials.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A control barrier comprising:

a barrier wall comprising a front face and an opposing back face each extending between a top end and an opposing bottom end, a first recess being formed at the bottom end of the barrier wall and extending between the front face and the opposing back face;

an opening extending through a portion of the barrier wall and communicating with the first recess, at least a portion of the opening forming a first engaging portion having a non-circular transverse cross-section;

an elongated first leg having an exterior surface extending between a first end and an opposing second end, a portion of the exterior surface forming a second engaging portion having a non-circular transverse cross-section, the first leg being slidably movable within the opening between a first position wherein the first leg is free to rotate within the opening over an angle of at least 45° and a second position wherein the second engaging portion is interlocked within the second engaging portion so as to substantially preclude rotation of the first leg within the opening; and a first foot mounted on the elongated first leg.

2. The control barrier as recited in claim 1, wherein the first engaging portion of the opening has a polygonal transverse cross-section.

3. The control barrier as recited in claim 1, wherein the second engaging portion of the first leg has a polygonal transverse cross-section.

4. The control barrier as recited in claim 1, wherein barrier wall terminates at a bottom surface that extends between a first side surface and an opposing second side surface, the first recess being formed on the bottom surface, wherein at least a portion of the first foot projects past the bottom surface of the barrier wall when the first leg is in the first position and wherein the first foot does not project past the bottom surface of the barrier wall when the first leg is in the second position.

5. The control barrier as recited in claim 1, further comprising:

an elongated second leg being rotatably coupled with the barrier wall; and a second foot mounted on the elongated second leg.

6. A control barrier comprising:

a barrier wall comprising a front face and an opposing back face each extending between a top surface and an opposing bottom surface, a first recess being formed on the bottom surface and extending through the barrier wall from the front face to the back face, the first recess being partially bounded by a shoulder of the barrier wall;

a first coupling wall projecting from the shoulder into the first recess, the first coupling wall having an inside face that is inset from the front face of the barrier wall and having an inside edge that is disposed adjacent to a passage, the passage comprising a portion of the recess extending through the barrier wall; and the first foot being movable between a first position wherein at least a portion of the first foot is positioned on top of the inside face of the first coupling wall and a second position wherein the first foot is rotated a least 45° relative to the first position and is removably positioned within the passage extending through the barrier wall.

7. The control barrier as recited in claim 6, wherein the first foot has a first side face and an opposing second side face with a first channel being formed on the first side face, the inside edge of the first coupling wall being disposed within the first channel when the first foot is in the second position.

8. The control barrier as recited in claim 6, wherein the first foot is mounted on a leg that is coupled with the barrier wall.

9. A control barrier comprising:

a barrier wall comprising a front face and an opposing back face each extending between a top end and an opposing bottom end, a first recess being formed on the front face at the bottom end of the barrier wall;

a first slot extending through the barrier wall from the first recess to the back face; and the first foot being movable between a first position wherein the first foot is at least partially disposed within the recess of the barrier wall and a second position wherein the first foot is rotated a least 45° relative to the first position and is removably positioned within the slot extending through the barrier wall.

10. The control barrier as recited in claim 9, wherein the first foot has a first side face and an opposing second side face wherein the first side face of the first foot is disposed substantially flush with the front face of the barrier wall when the first foot is in the first position.

11. The control barrier as recited in claim 9, wherein the first foot has a first side face and an opposing second side face with a first channel being formed on the first side face, at least a portion of the barrier wall being disposed within the first channel when the first foot is in the second position.

12. The control barrier as recited in claim 11, wherein the first foot has a second channel formed on the second face, at least a portion of the barrier wall being disposed within the second channel when the first foot is in the second position.

13. The control barrier as recited in claim 9, wherein barrier wall terminates at a bottom surface that extends between a first side surface and an opposing second side surface, wherein at least a portion of the first foot projects past the bottom surface of the barrier wall when the first foot is in the second position and wherein the first foot does not project past the bottom surface of the barrier wall when the first foot is in the first position.

14. The control barrier as recited in claim 9, wherein the first foot is rotated in a range between about 75° and about 105° relative to the first position when the first foot is moved from the first position to the second position.

15. The control barrier as recited in claim 9, further comprising:

the front face being substantially planer and being disposed in a first plane;

the back face being substantially planer and being disposed in a second plane, the first plane and the second plane being disposed in substantially parallel alignment.

16. The control barrier as recited in claim 9, wherein the barrier wall has an interior surface that bounds a chamber, the chamber being adapted to hold a ballast, the barrier wall having a fill hole through which a ballast can be delivered to the chamber.

17. The control barrier as recited in claim 9, further comprising means for securing the first foot within the recess.

18. The control barrier as recited in claim 9, wherein at least a portion of the recess extends between the front face and the back face of the barrier wall.

19. The control barrier as recited in claim 9, further comprising a second foot movably coupled with the barrier wall.

20. The control barrier as recited in claim 9, wherein the first foot is mounted on a leg that is coupled with the barrier wall.

* * * * *

UNITED STATES PATENT AND TRADEMARK OFFICE

CERTIFICATE OF CORRECTION

PATENT NO. : 7,789,585 B2
APPLICATION NO. : 12/475990
DATED : September 7, 2010
INVENTOR(S) : Christensen et al.

It is certified that error appears in the above-identified patent and that said Letters Patent is hereby corrected as shown below:

Column 5
Line 11, change “such as” to --such a--
Line 60, change “moved” to --be moved--

Column 6
Line 11, change “filed” to --filled--

Column 7
Line 36, change “is” to --that is--
Line 37, change “receive” to --received--

Column 8
Line 12, change “wall 12 is” to --wall 12 in--.
Line 27, change “secured” to --secured to--
Line 32, change “slide” to --slid--

Column 9
Line 13, change “118” to --18--
Line 40, change “112” to --12--
Line 40, change “insides” to --inside--
Line 41, change “leg 90” to --leg 150--
Line 43, change “rotate” to --rotated--
Line 45, change “lock” to --locked--

Column 11
Line 4, change “rotated a least” to --rotated at least--

Signed and Sealed this
Twenty-eighth Day of June, 2011

David J. Kappos

David J. Kappos
*Director of the United States Patent and Trademark Office*